US005088747A

United States Patent [19]

Morrison et al.

[11] Patent Number: 5,088,747

[45] Date of Patent: Feb. 18, 1992

[54] WHEELCHAIR SEATING SYSTEM

[75] Inventors: Clark Morrison, Southfield; Charles F. Stoyka, Troy, both of Mich.

[73] Assignee: International Marketing and Design Seating System, Inc., Birmingham, Mich.

[21] Appl. No.: 581,043

[22] Filed: Sep. 12, 1990

[51] Int. Cl.[5] ..... A47K 27/00

[52] U.S. Cl. ..... 297/219; 297/218; 297/231; 297/283

[58] Field of Search ..... 297/219, 218, 223, 226, 297/231, 283, 284, DIG. 1, DIG. 4, DIG. 6; 280/304.1

[56] References Cited

U.S. PATENT DOCUMENTS

| | | | |
|---|---|---|---|
| 2,782,839 | 2/1957 | Cole | 297/219 |
| 3,603,639 | 9/1971 | Wilson | 297/219 |
| 3,659,297 | 5/1972 | Schutz | 297/219 X |
| 4,630,863 | 12/1986 | Roberts | 297/219 |
| 4,772,070 | 9/1988 | Leto, Jr. et al. | 297/219 |
| 5,007,676 | 4/1991 | Lien | 297/219 X |

*Primary Examiner*—Laurie K. Cranmer

*Attorney, Agent, or Firm*—Harness, Dickey & Pierce

[57] ABSTRACT

A wheelchair has a seating support system. The seating support system has a horizontal seat support including a cushion which provides hard or firm as well as cushioned soft seat characteristics. likewise, a vertical back cushion is included which has a removable member providing hard or firm as well as cushioned soft back characteristics.

16 Claims, 2 Drawing Sheets

Fig-3
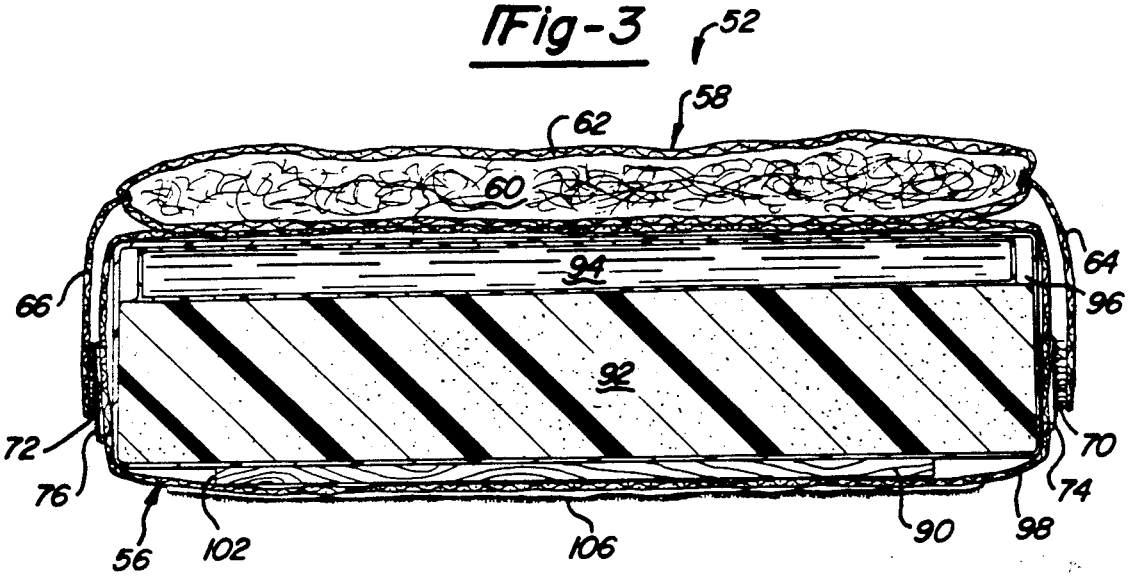
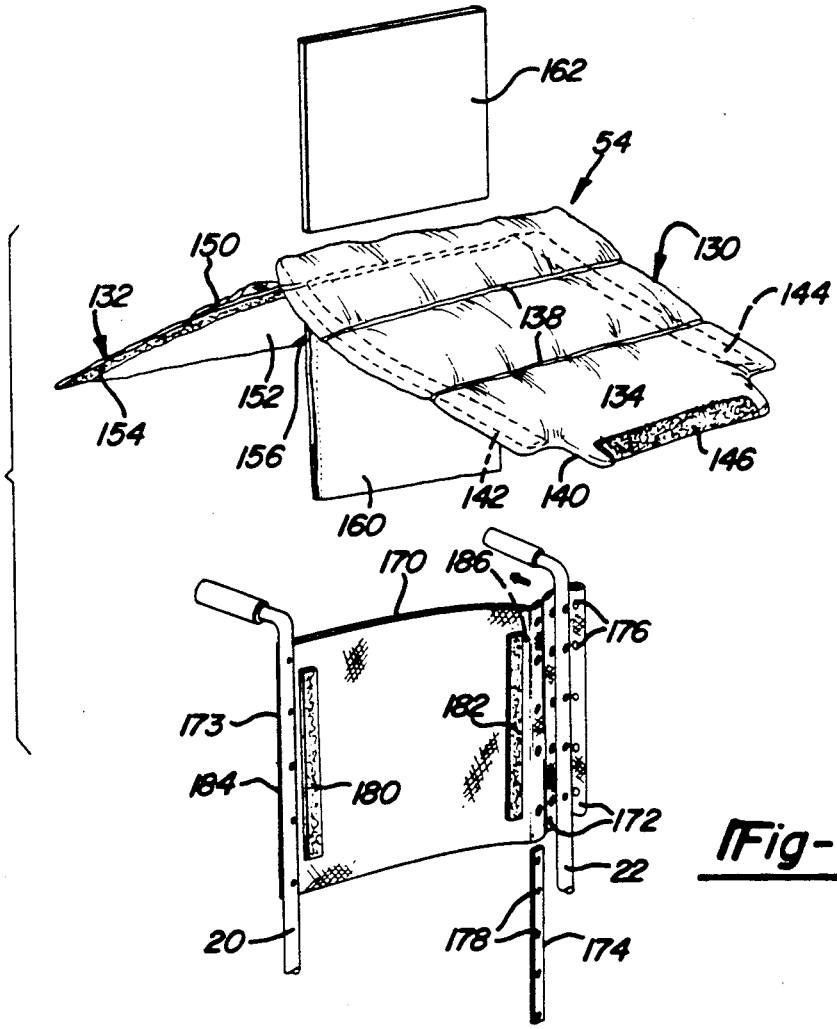
Fig-4

WHEELCHAIR SEATING SYSTEM

BACKGROUND AND SUMMARY OF THE INVENTION

The present invention relates to wheelchairs and, more particularly, to a seating system for a collapsible wheelchair.

Two basic types of wheelchairs exist in the art. One type is foldable or collapsible wheelchairs. Foldable or collapsible wheelchairs have two substantially identical support sections separated by foldable back and seat slings. These wheelchairs are easily folded together to be transported, usually by vehicles, from place to place. The second type of wheelchair includes a fixed hard seat and back support arrangement. Generally these types of wheelchairs are found in places where they are used daily where there is no need to collapse the chair. These hard seat and back support wheelchairs may include cushions, however, while providing comfort, the wheelchairs are not easily portable or transportable in a vehicle.

It is desirable to provide a collapsible or foldable wheelchair which exhibits both sling seat and back and hard seat and back support characteristics while maintaining its foldable or collapsible feature. Also, it is desirable to provide maximum comfort to the foldable wheelchair user. A seating system which is capable of providing these characteristics should be easily removable from the wheelchair and economically feasible.

Accordingly, the present invention provides the art with a removable seating system which exhibits both sling and hard seat and back support characteristics for foldable or collapsible wheelchairs. The present invention provides a seat and back which provide comfort and a "hard support" surface seat and back feel to the collapsible wheelchair user. The seating system enables easy removal from collapsible wheelchairs without interfering with collapsing of the chairs. The present invention provides a removable or disposable seat cushion pad which may be laundered or thrown out if necessary. The present invention also provides a seating system that is aesthetic pleasing.

From the below detailed description taken in conjunction with the accompanying drawings and subjoined claims, other objects and advantages of the present invention will become apparent to those skilled in the art.

BRIEF DESCRIPTION OF THE DRAWINGS

FIG. 3 is a sectional view of the horizontal seat cushion of FIG. 1 taken along line 3—3 thereof.

FIG. 4 is an exploded perspective view of the vertical back cushion of FIG. 1.

DETAILED DESCRIPTION OF THE PREFERRED EMBODIMENT

Figure 1:
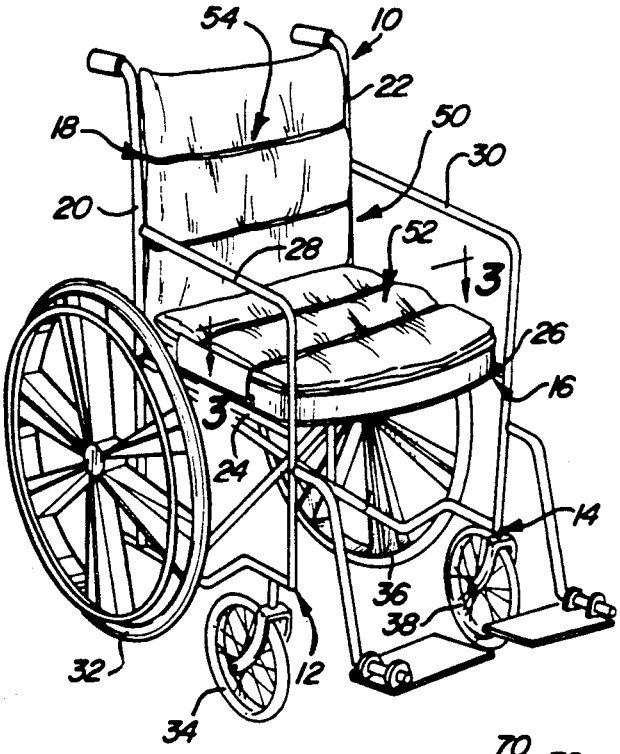
FIG. 1 is a perspective view of a wheelchair including a seating system in accordance with the present invention.

Referring to the Figures, particularly FIG. 1, a collapsible or foldable wheelchair is illustrated with a seating system in accordance with the present invention. The wheelchair 10 generally includes a pair of substantially identical support members 12 and 14 separated by seat 16 and back 18 slings. The support members 12 and 14 generally include vertical back support bars 20 and 22, horizontal seat support bars 24 and 26, arm rests 28 and 30, and supports for the wheels 32, 34, 36 and 38.

The seating system 50 generally includes a horizontal seat support 52 and a vertical back support 54. The seat support 52 has a width to span the seat sling 16 and provide an aesthetic appearance as seen in FIG. 1. Likewise, the back support 54 has a width to span the vertical back support and provide an equally pleasing aesthetic appearance.

Figure 2:
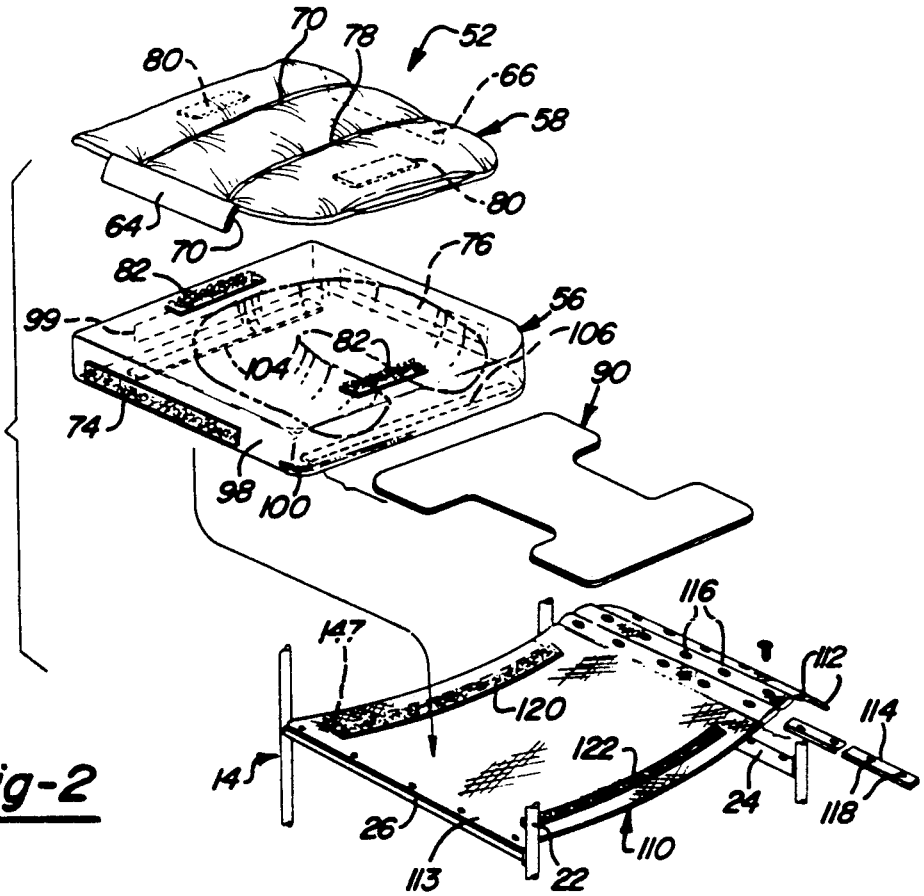
FIG. 2 is an exploded perspective view of the horizontal seat cushion of FIG. 1.

The horizontal seat cushion 52 generally includes a pair of cushion members 56 and 58. Cushion member 58 is an upper cushion and may be washable or discardable. Generally, the cushion 58 includes a foam pad 60 covered by a fabric 62 material as seen in FIG. 3. The upper cushion pad 58 includes attachment flaps 64 and 66 secured to the longitudinal edges of the cushion pad 58 as seen in FIG. 2. Generally the attachment flaps 64 and 66 include a strip of hook or loop fasteners 70 and 72 with a corresponding or mating strip of hook or loop fasteners 74 and 76 on the lower cushion 56. The lower side of the upper cushion 58 also includes a strip of hook or loop fastener 80 near one or both of its lateral edges to position the upper cushion 58 on a mating hook or loop fastener 82 on the lower cushion 56. Also fasteners such as snaps, buttons, zippers or the like may be utilized to removably secure the upper cushion 58 to the lower cushion 56. The upper pad 58 has stitching lines 78 or the like to provide an aesthetic appearance. The upper cushion 58 could be modified to include foam inserts and additional stitching to provide a contoured upper cushion. The cushion would be contoured to receive the user's thighs and buttocks as illustrated in phantom in FIG. 2.

The foam 60 used in the upper cushion is generally breathable and provides a soft cushioning feeling for the user's buttocks and thighs. Several types of foam exist which exhibit breathable characteristics while providing a cushion soft feel. The fabric 62 covering the pad 60 is generally of a waterproof breathable fabric type. The fabric 62 may be washed or cleaned to provide a re-usable upper cushion. A fabric which works well is sold under the "Ultrex" trademark manufactured by Burlington Industries, Inc.

The lower cushion 56 includes a removable member 90, a foam member 92, a gel layer 94, a membrane 96 encasing the gel and foam member, and a fabric covering 98. The support member 90 is a board-like member having a width substantially less than that of the wheelchair seat sling 16 so that the edges of the support member 90 are supported by the seat sling 16 when force is applied on the cushion 52. The width of the support member 90 is less than the width of the foam member 92 as seen in FIG. 3. The support member 90 has an overall I-shape which provides a universal base with firm hard seat characteristic to the soft cushion 52. The support member 90 may be manufactured from a pressboard, wood, metallic or polymeric material.

The foam pad 92 is of a light-weight durable material providing excellent support and having an overall rectangular shape sized to fit between the supports 12 and 14. The foam pad 92 is generally manufactured from a visco elastic foam which contours slowly to form fit the user's buttocks and thighs. The foam pad 92 has an open cell structure which allows maximum air circulation. Also, the foam pad 92 absorbs tremendous impact forces. One such foam material is manufactured under the trademark "Sunmate" and distributed by Dynamic Systems, Inc.

The gel layer 94 is of a soft polymeric gel having waterproof and breathable characteristics bonded to the foam layer 92 as seen in FIG. 3. The gel 94 along with the foam 92 enables the buttocks and thighs to sink so that it positions the body profile and disperses the pressure across the buttocks and thighs to a larger area. The gel 94 helps to eliminate high pressure spots by spreading out the pressure over this larger area. The reduction in pressure enables better circulation of the blood to all parts of the body. The gel 94 also acts as a heat sink. Since the gel layer has a large surface area with respect to the body positioned on it, the gel 94 dissipates heat rapidly to maintain a constant temperature. The gel layer 94 eliminates heat relatively rapidly enabling the body to experience a cool feeling surface lowering the body perspiration rate.

The foam pad 92 and gel layer 94 are covered by a membrane 96 to provide a barrier between the gel 94 and foam pad 92 and the outer fabric cover 98. The barrier 96 having a bag shape is of a micro porous membrane being highly breathable and exhibiting waterproof characteristics. One such membrane is sold under the "Repel" trademark by Gelman Sciences Technology, Ann Arbor, Michigan.

The fabric cover 98 is of a bag-type construction having a zipper 100 or the like enabling removable positioning of the support member 90, foam pad 92 with gel 94 encased in membrane 96 into the cover 98. The cover 98 includes a pocket 102 for receiving and positioning the support member 90 within the cover 98. This pocket 102 maintains the support member 90 in proper position when it is positioned onto the seat sling 16 of the wheelchair. The cover 98 is manufactured from a fabric material like the material distributed under the "Ultrex" trademark previously described. The cover 98 includes a fabric handle 99 to enable easy manipulation of the cushion 52. The cover 98 includes hook or loop fasteners 104 and 106 on its bottom surface to mate with hook or loop fasteners on a seat sling to maintain the cushion 52 in position on the sling 16. Whichever hook or loop fastener is secured to the cover 98 the mating hook or loop fastener would be secured onto the sling. Hook or loop fasteners which work satisfactory or like those distributed under the "Velcro" trademark. Other removable fasteners as mentioned above as well as releasable adhesives may be utilized.

While the above seating system 50 may be utilized on existing foldable or collapsible wheelchairs, it is preferred that the wheelchairs be modified to include the below described seat and back sling suspension system. The description of the suspension seat sling will follow while the back sling will be discussed herein.

A sling seat 110 may be substituted on existing wheelchairs or may be installed as original equipment. The seat sling 110 may be adjusted for tension or slack between the support members. The seat sling 110 includes a rectangular sheet of material having a plurality of pockets 112 at one end of the seat sling 110 and a single pocket 113 at the other end. The pockets 112 enable a strip 114, metallic or plastic, to be removably positioned into the pockets. The pockets 112 as well as the strip 114 have a plurality of apertures 116 and 118 to enable the fasteners to pass therethrough to be secured to the chair. The pockets 112 may be positioned upon one another in an accordion-type pleat so that the fastener passes through all the aperture 116 in the pockets 112 to provide an aesthetic appearance or the last pocket may just be folded back upon the pocket being used and the material of the suspension sling 110 may bulge inside of the support 12 and 14. By positioning the strip 114 in different pockets, the tension or slack in the sling 110 may be adjusted. The single pocket 113 includes a strip secured therein and is stationarily secured to the wheelchair support. Strips of hook or loop fasteners 120 and 122 are sewn on to the suspension sling for mating with fasteners 104 and 106 to position the cushion 56 on the seat sling 110. The sling 110 is generally manufactured from a strong durable material like that sold under the trademark "Dymetrol" manufactured by DuPont, Wilmington, Delaware.

The back cushion 54 of the seating system generally includes a rectangular elongated member having a cushion portion 130 and a flap portion 132. The cushion portion 130 is similar to the upper removable cushion 58 previously described. The cushion portion 130 includes a foam pad insert covered by a fabric material outer covering 134. The foam pad is substantially similar to the foam 60 pad described on the upper cushion 58. Likewise, the fabric covering 134 is preferably "Ultrex" material ,like that previously described. The cushion portion 130 may include stitching lines 138 or the like providing a pleasing aesthetic appearance. The under side 140 of the cushion portion 130 includes a pair of strips of either hook or loop fasteners 142 and 144 on its longitudinal edges to secure the back cushion to corresponding or mating hook or loop fasteners on the vertical back sling of the wheelchair. Also, a hook or loop fastener 146 is positioned along the lateral bottom edge of the cushion portion 130 for mating with a hook or loop fastener 122 on the bottom of sling 110 to close off the back and prevent objects from falling out of the wheel chair. As mentioned above, any type of removable fastener may be utilized to secure the back cushion to itself on the back sling.

The flap portion 132 is generally formed continuously with fabric covering 134 including a material pocket 150. The under side 152 of the fabric flap 132 includes hook or loop fasteners 154 and 156 on the longitudinal edges for securing with corresponding or mating hook or loop fasteners on the back of the wheelchair back sling. Thus, the flap portion 132 is secured to the back of the wheelchair vertical sling or the vertical support to retain the flap 132 in position.

At the junction of the cushion portion 130 and flap portion 132, a zipper (not shown) or the like is positioned to enable access into a support member pocket 160. The support member pocket 160 includes a support member 162. The support member 162 is a rectangular board-like member having a width less than the width of the vertical back sling. The member 162 may be manufactured from wood, pressboard, metallic or polymeric material.

The support member 162 may be moved in position from in front of the back sling to behind the back sling. When the support member 162 is in front of the back sling, it provides hard back support surface characteristic. When the support member 162 is moved to behind the back sling, and the hard support is removed, the support member pocket becomes a storage pocket.

A sling back 170 may be substituted on existing wheelchairs or may be installed as original equipment. The sling back 170 may be adjusted for tension or slack between the support members like the seat sling 110 as explained above. The sling back 170 includes a rectangular sheet of material having a plurality of pockets 172 at one end of the sling back 170 and single pocket 173 at the other end. The pockets 172 enable a strip 174, metallic or plastic, to be removably positioned into the pockets 172. The pockets 172 as well as the strip 174 have a plurality of apertures 176 and 178 to enable the fasteners to pass therethrough to be secured to the chair supports. The pockets 172 may be positioned upon one another in an accordiontype pleat so that the fastener passes through all the aperture 176 in the pockets 172 to provide an aesthetic appearance or the last pocket may just be folded back upon the pocket being used and the material of the suspension sling back 170 may bulge inside of the support 20 or 22. By positioning the strip 174 in different pockets, the tension or slack in the sling 170 may be adjusted. The single pocket 173 includes a strip secured therein and is stationarily secured to the wheelchair support. Strips of hook or loop fasteners 180, 182, 184 and 186 are sewn on to the suspension sling back 170 for mating with fasteners 142, 144, 154 and 156 to position the cushion 54 on the seat sling back 170. The sling back 170 is generally manufactured from a strong durable material like that sold under the trademark "Dymetrol" manufactured by DuPont, Wilmington, Delaware.

While the above detailed description describes a preferred embodiment of the present invention, it will be understood that the present invention is susceptible to modification, variation and alteration without deviating from the scope and fair meaning of the subjoined claims.

What is claimed is:

1. A seating system for a collapsible wheelchair having a pair of supports defining a horizontal seat sling and vertical back sling seating area, said seating system comprising:

a first removable cushion adapted for positioning adjacent said seat sling providing a cushioned horizontal seat, said cushion having a removable board member with a width for enabling said board member to be positioned between the pair of supports for providing a firm support surface exhibiting hard support surface characteristics, and a foam pad means for providing a cushioned seating surface;

a second removable cushion adapted for positioning adjacent the vertical back sling to provide a cushioned vertical back, said second cushion including removable means for providing a firm or hard support surface exhibiting fixed or hard support surface characteristics, and a foam pad means for providing a cushioned back surface.

2. The seating system according to claim 1, wherein said first removable cushion includes means for securing said first cushion to said sling.

3. The seating system according to claim 2, wherein said securing means is comprised of hook and loop fasteners.

4. The seating system according to claim 1, further comprising a third removable cushion for securing to said first cushion for providing additional cushioning for said seating surface.

5. The seating system according to claim 4, wherein hook and loop fasteners secure said third cushion to said first cushion.

6. The seating system according to claim 4, wherein said third cushion is contoured.

7. The seating system according to claim 1, wherein said first cushion foam pad means includes a foam pad having a width substantially equal to the distance between the pair of supports, a gel layer on said foam layer, a membrane cover encasing said foam and gel layer and a cover enclosing said board member, foam pad and gel layer.

8. The seating system according to claim 7, wherein said cover includes a pocket for maintaining said board member in position.

9. The seating system according to claim 1, wherein said second cushion including a removable board member having a width less than the distance between said pair of supports, a foam pad having a width substantially equal to the distance between said pair of supports and a cover enclosing said board member and said foam pad.

10. The seating system according to claim 8, wherein said cover includes a pocket for maintaining said board member in position.

11. The seating system according to claim 10, wherein said board member is movable to a position behind the vertical back sling, removing the hard back characteristics.

12. The seating system according to claim 1, wherein said second cushion includes means for securing said second cushion to the vertical back sling of the wheelchair.

13. The seating system according to claim 12, wherein said securing means includes hook and loop fasteners.

14. The seating system according to claim 1, further including a suspension means for adjusting tension or slack between the pairs of supports, said suspension means spanning between the pair of supports.

15. The seating system according to claim 13, wherein said suspension means includes a seat sling and back sling with mans for adjustably securing said slings to the support members.

16. A seating system for a collapsible wheelchair having a pair of supports defining a horizontal seat sling and vertical back sling seating area, said seating system comprising:

a removable cushion adapted for positioning adjacent said seat sling providing a cushioned horizontal seat, said cushion having a removable board member with a width for enabling said board member to be positioned between the pair of supports for providing a first support surface exhibiting hard support surface characteristics, and a foam pad means for providing a cushioned seating surface.

* * * * *

UNITED STATES PATENT AND TRADEMARK OFFICE

CERTIFICATE OF CORRECTION

PATENT NO. : 5,088,747

DATED : Feb. 18, 1992

INVENTOR(S) : Morrison et al.

It is certified that error appears in the above-identified patent and that said Letters Patent is hereby corrected as shown below:

| | |
|---|---|
| On the title page, Abstract, line 4: | "likewise" should be --Likewise-- |
| col. 4, line 24: | ",like" should be --like-- |
| col. 6, line 25, claim 10: | "8" should be --9-- |
| col. 6, line 43, claim 15: | "13" should be --14-- |
| col. 6, line 45, claim 15: | "mans" should be --means-- |
| col. 6, line 56, claim 16: | "first" should be --firm-- |

Signed and Sealed this

Twenty-eighth Day of December, 1993

*Attest:*

Bruce Lehman

BRUCE LEHMAN

*Attesting Officer*

*Commissioner of Patents and Trademarks*